US010391010B2

(12) United States Patent
Ribble et al.

(10) Patent No.: US 10,391,010 B2
(45) Date of Patent: Aug. 27, 2019

(54) SLEEP DISORDER TREATMENT DEVICES, SYSTEMS, AND METHODS

(71) Applicant: Hill-Rom Services, Inc., Batesville, IN (US)

(72) Inventors: David L. Ribble, Indianapolis, IN (US); Joshua A. Williams, West Harrison, IN (US); Kirsten M. Emmons, Batesville, IN (US); Brian L. Lawrence, Cincinnati, OH (US); Douglas A. Eckstein, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 229 days.

(21) Appl. No.: 15/431,985

(22) Filed: Feb. 14, 2017

(65) Prior Publication Data

US 2017/0245656 A1 Aug. 31, 2017

Related U.S. Application Data

(60) Provisional application No. 62/300,340, filed on Feb. 26, 2016.

(51) Int. Cl.

| | |
|---|---|
| ***A61G 7/07*** | (2006.01) |
| ***A61G 7/00*** | (2006.01) |
| *A61G 7/05* | (2006.01) |

(52) U.S. Cl.

CPC ..... *A61G 7/07* (2013.01); *A61G 7/001* (2013.01); *A61G 7/0525* (2013.01)

(58) Field of Classification Search

CPC ..... A61G 7/07

(Continued)

(56) References Cited

U.S. PATENT DOCUMENTS

| | | | |
|---|---|---|---|
| 3,775,785 | A | 12/1973 | Mittendorf |
| 4,754,510 | A | 7/1988 | King |

(Continued)

FOREIGN PATENT DOCUMENTS

| | | |
|---|---|---|
| DE | 4137631 | 5/1992 |
| EP | 262771 | 4/1991 |

(Continued)

OTHER PUBLICATIONS

Adesanya, Adebola O., et al., *Perioperative Management of Obstructive Sleep Apnea*, CHEST/138/6, Dec. 2010 (10 pages).

(Continued)

*Primary Examiner* — Fredrick C Conley

(74) *Attorney, Agent, or Firm* — Barnes & Thornburg LLP

(57) ABSTRACT

A sleep system is provided comprising a head support section, a torso support section, a leg support section, and a cradle surface provided on at least an upper portion of the torso support section. The head support section is generally laterally angled at an angle greater than the lateral angle of the torso support section and the leg support section. The cradle surface has at least a partial curvature and a lateral width of from about 12 inches to about 36 inches. The lateral angle of the head support section is at least about 10 degrees, the lateral angle of the torso support section is greater than the lateral angle of the leg support section, and the lateral angle of the leg support section is less than about 10 degrees.

20 Claims, 9 Drawing Sheets

(58) Field of Classification Search
USPC ..... 5/615, 607, 609, 81.1 R
See application file for complete search history.

(56) References Cited

U.S. PATENT DOCUMENTS

| | | | | |
|---|---|---|---|---|
| 4,807,313 | A | 2/1989 | Ryder et al. | |
| 4,841,221 | A * | 6/1989 | Barney | G01D 5/14 315/194 |
| 5,092,007 | A | 3/1992 | Hasty | |
| 5,097,551 | A | 3/1992 | Smith | |
| 5,611,096 | A | 3/1997 | Bartlett et al. | |
| 5,745,937 | A | 5/1998 | Weismiller et al. | |
| 5,754,998 | A | 5/1998 | Selton | |
| 5,910,080 | A | 6/1999 | Selton | |
| 5,966,762 | A | 10/1999 | Wu | |
| 6,047,419 | A | 4/2000 | Ferguson | |
| 6,081,950 | A | 7/2000 | Selton | |
| 6,154,900 | A | 12/2000 | Shaw | |
| 6,163,903 | A | 12/2000 | Weismiller et al. | |
| D446,676 | S | 8/2001 | Mayes | |
| 6,370,716 | B1 | 4/2002 | Wilkinson | |
| 6,485,441 | B2 | 11/2002 | Woodward | |
| 6,536,056 | B1 | 3/2003 | Vrzalik et al. | |
| 6,671,907 | B1 | 1/2004 | Zuberi | |
| 6,681,424 | B1 | 1/2004 | Bourgraf et al. | |
| 6,751,817 | B1 | 6/2004 | Leach | |
| 6,904,631 | B2 | 6/2005 | Vrzalik et al. | |
| 7,007,327 | B2 | 3/2006 | Ogawa et al. | |
| 7,017,213 | B2 | 3/2006 | Chisari | |
| 7,089,615 | B1 | 8/2006 | Parimuha | |
| D527,937 | S | 9/2006 | Aiken et al. | |
| 7,346,945 | B2 | 3/2008 | Phillips et al. | |
| 7,418,751 | B1 | 9/2008 | Bartlett et al. | |
| 7,464,422 | B2 | 12/2008 | Townsend | |
| 7,513,003 | B2 | 4/2009 | Mossbeck | |
| 7,654,974 | B2 | 2/2010 | Bass | |
| 7,690,059 | B2 | 4/2010 | Lemire et al. | |
| 7,805,784 | B2 | 10/2010 | Lemire et al. | |
| 7,861,334 | B2 | 1/2011 | Lemire et al. | |
| 7,886,379 | B2 | 2/2011 | Benzo et al. | |
| 7,962,981 | B2 | 6/2011 | Lemire et al. | |
| 7,975,335 | B2 | 7/2011 | O'Keefe et al. | |
| 8,006,332 | B2 | 8/2011 | Lemire et al. | |
| 8,220,091 | B2 | 7/2012 | Schultz | |
| 8,261,380 | B2 | 9/2012 | Ferraresi et al. | |
| 8,356,602 | B2 | 1/2013 | Crocetti | |
| 8,393,026 | B2 | 3/2013 | Dionne et al. | |
| 8,413,271 | B2 | 4/2013 | Blanchard et al. | |
| 8,544,126 | B2 | 10/2013 | Elliott et al. | |
| 8,661,586 | B2 | 3/2014 | Melcher et al. | |
| 8,689,376 | B2 | 4/2014 | Becker et al. | |
| 8,695,134 | B2 | 4/2014 | Schultz | |
| 8,701,229 | B2 | 4/2014 | Lemire et al. | |
| 8,720,447 | B2 | 5/2014 | North | |
| 8,756,736 | B1 | 6/2014 | Minson | |
| 8,789,222 | B2 | 7/2014 | Blanchard et al. | |
| 8,832,887 | B2 | 9/2014 | Mossbeck | |
| 8,844,076 | B2 | 9/2014 | Becker et al. | |
| 8,870,764 | B2 | 10/2014 | Rubin | |
| 9,038,217 | B2 | 5/2015 | Elliott et al. | |
| 9,126,571 | B2 | 9/2015 | Lemire et al. | |
| 2006/0179580 | A1 | 8/2006 | Robertson et al. | |
| 2007/0163051 | A1 | 7/2007 | Straub | |
| 2008/0109965 | A1 | 5/2008 | Mossbeck | |
| 2008/0148487 | A1 | 6/2008 | Lord et al. | |
| 2009/0250070 | A1 | 10/2009 | Pfeifer | |
| 2010/0138998 | A1 * | 6/2010 | Wilkinson | A61G 7/001 5/615 |
| 2011/0231996 | A1 | 9/2011 | Lemire et al. | |
| 2012/0222214 | A1 | 9/2012 | Lachenbruch et al. | |
| 2013/0245395 | A1 | 9/2013 | Bidarian Moniri | |
| 2014/0059768 | A1 | 3/2014 | Lemire et al. | |
| 2014/0088373 | A1 | 3/2014 | Phillips et al. | |
| 2014/0173829 | A1 | 6/2014 | Melcher et al. | |
| 2014/0180036 | A1 | 6/2014 | Bukkapatnam et al. | |
| 2014/0245539 | A1 * | 9/2014 | Ooba | A47C 20/048 5/636 |
| 2014/0259417 | A1 | 9/2014 | Nunn et al. | |
| 2014/0259418 | A1 | 9/2014 | Nunn et al. | |
| 2014/0259419 | A1 | 9/2014 | Stusynski et al. | |
| 2014/0259433 | A1 | 9/2014 | Nunn et al. | |
| 2014/0259434 | A1 | 9/2014 | Nunn et al. | |
| 2014/0266733 | A1 | 9/2014 | Hayes et al. | |
| 2014/0277611 | A1 | 9/2014 | Nunn et al. | |
| 2014/0277822 | A1 | 9/2014 | Nunn et al. | |
| 2014/0283302 | A1 | 9/2014 | Horstmann | |
| 2015/0000035 | A1 | 1/2015 | Becker et al. | |

FOREIGN PATENT DOCUMENTS

| | | |
|---|---|---|
| EP | 2175822 | 1/2012 |
| EP | 2140847 | 7/2012 |
| EP | 2494946 | 9/2012 |
| JP | 2011-143237 | 7/2011 |
| JP | WO 2013/031504 | 7/2013 |
| KR | 20110083167 | 7/2011 |
| WO | WO 2010/048310 | 4/2010 |
| WO | WO 2013/166003 | 4/2013 |
| WO | WO 2014/069713 | 5/2014 |
| WO | WO 2014/151707 | 9/2014 |
| WO | WO 2014/152891 | 9/2014 |

OTHER PUBLICATIONS

Ankichetty, Saravanan and Frances Chung, *Considerations for Patients with Obstructive Sleep Apnea Undergoing Ambulatory Surgery*, Current Opinion in Anesthesiology 2011, 24:605-611 (7 pages).

Arnold, Donald H., et al., *Estimation of Airway Obstruction Using Oximeter Plethysmograph Waveform Data*, Respiratory Research 2005, 6:65 (8 pages).

American Society of Anesthesiologists, Inc., *Practice Guidelines for the Perioperative Management of Patients with Obstructive Sleep Apnea*, Anesthesiology 2006, V. 104, 1081-93, No. 5, May 2006, (13 pages).

Benumof, Jonathan L., *Obstructive Sleep Apnea in the Adult Obese Patient: Implications for Airway Management*, Journal of Clinical Anesthesia 13:144-156, 2001 (13 pages).

Berend, Keith R., et al., *Prevalence and Management of Obstructive Sleep Apnea in Patients Undergoing Total Joint Arthroplasty*, The Journal of Arthroplasty vol. 25 No. 6 Suppl. 1 2010 (4 pages).

Berger, G., et al., *Progression of Snoring and Obstructive Sleep Apnoea: The Role of Increasing Weight and Time*, European Respiratory Journal, vol. 33, No. 2, 2009 (8 pages).

Bianchi, Matt T., *Screening for Obstructive Sleep Apnea: Bayes Weighs In*, The Open Sleep Hournal, 2009, 2, 56-59 (4 pages).

Bignold, James J., et al., *Accurate Position Monitoring and Improved Supine-Dependent Obstructive Sleep Apnea with a New Position Recording and Supine Avoidance Device*, Journal of Clinical Sleep Medicine, vol. 7, No. 4, 2001 (8 pages).

Bloom, Harrison G., et al., *Evidence-Based Recommendations for the Assessment and Management of Sleep Disorders in Older Persons*, J Am Geriatr Soc 57:761-789, 2009 (30 pages).

Bolden, Norman, et al., *Avoiding Adverse Outcomes in Patients with Obstructive Sleep Apnea (OSA): Development and Implementation of a Perioperative OSA Protocol*, Journal of Clinical Anesthesia (2009) 21, 286-293 (8 pages).

Bourne, Richard S., et al., Clinical Review: *Sleep Measurement in Critical Care Patients: Research and Clinical Implications*, Critical Care 2007, 11:226 (17 pages).

Brown, Carlos VR and George C. Velmahos, *The Consequences of Obesity on Trauma, Emergency Surgery, and Surgical Critical Care*, World Journal of Emergency Surgery 2006, 1:27 (5 pages).

Bush, Haydn, *Screening for Sleep Apnea*, American Hospital Association Health Forum, Hospital & Health Networks, hhn@omeda.com, 2013 (2 pages).

Camilo, Millene R., et al., *Supine Sleep and Positional Sleep Apnea After Acute Ischemic Stroke and Intracerebral Hemorrhage*, CLINICS 2012; 67(12); 1357-1360 (4 pages).

(56) References Cited

OTHER PUBLICATIONS

Carr, Gordon E., et al., *Acute Cardiopulmonary Failure From Sleep-Disordered Breathing*, CHEST 2012; 141(3); 798-808 (11 pages).
Casey, Kenneth R. and Michael J. Lefor, *Management of the Hospitalized Patient with Sleep Disordered Breathing*, Current Opinion in Pulmonary Medicine 2002, 8:511-515 (5 pages).
Chia, P., et al., *The Association of Pre-Operative STOP-BANG Scores with Postoperative Critical Care Admission*, Anaesthesia 2013, 68, 950-952 (3 pages).
Choi, Jae-Kap, et al., *Effect of Jaw and Head Position on Airway Resistance in Obstructive Sleep Apnea*, Sleep and Breathing, vol. 4, No. 4, 163-168, 2000 (8 pages).
Choi, Ji Ho, et al., *Efficacy Study of a Vest-Type Device for Positional Therapy in Position Dependent Snorers*, Sleep and Biological Rhythms 2009; 7; 181-187 (7 pages).
Chung, Sharon A., et al., *A Systemic Review of Obstructive Sleep Apnea and Its Implications for Anesthesiologists*, Ambulatory Anesthesiology, vol. 107, No. 5, Nov. 2008, 1543-1563 (21 pages).
Chung, F., et al., *High STOP-Band Score Indicates a High Probability of Obstructive Sleep Apnoea*, British Journal of Anaesthesia 108 (5): 768-75 (2012), (8 pages).
Chung, Frances and Babak Mokhlesi, *Postoperative Complications Associates with Obstructive Sleep Apnea: Time to Wake Up!*, Anesthesia & Analgesia, Feb. 2014, vol. 118, No. 2, 251-253 (3 pages).
Chung, Frances et al., *Preoperative Identification of Sleep Apnea Risk in Elective Surgical Patient6s, Using the Berlin Questionnaire*, Journal of Clinical Anesthesia (2007) 19, 130-134 (5 pages).
Chung, Frances and Hisham Elsaid, *Screening for Obstructive Sleep Apnea Before Surgery: Why is it Important?*, Current Opinion in Anaesthesiology 2009, 22:405-411 (7 pages).
Chung, Frances, et al., *Validation of the Berlin Questionnaire and American Society of Anesthesiologists Checklist as Screening Tools for Obstructive Sleep Apnea in Surgical Patients*, Anesthesiology, vol. 108, No. 5, May 2008, 822-830 (9 pages).
Curry, J. Paul and Lawrence A. Lynn, *Threshold Monitoring, Alarm Fatigue, and the Patterns of Unexpected Hospital Death*, The Official Journal of the Anesthesia Patient Safety Foundation, Fall 2011 (8 pages).
D'Apuzzo, Michele R. and James A. Browne, *Obstructive Sleep Apnea as a Risk Factor for Postoperative Complications After Revision Joint Arthroplasty*, The Journal of Arthroplasty, vol. 27, No. 8, Suppl. 1 (2012), 95-98 (4 pages).
Der Herder, Cindy, et al., *Risks of General Anaesthesia in People with Obstructive Sleep Apnoea*, British Medical Journal, vol. 329, Oct. 23, 2004, 955-959 (5 pages).
Dolezal, Donna, et al., *Implementing Preoperative Screening of Undiagnosed Obstructive Sleep Apnea*, Journal of PeriAnesthesia Nursing, vol. 26, No. 5 (October), 2011, 338-342 (5 pages).
Ead, Heather, *Meeting the Challenge of Obstructive Sleep Apnea: Developing a Protocol that Guides Perianesthesia Patient Care*, Journal of PeriAnesthesia Nursing, vol. 24, No. 2 (April), 2009, 103-113 (11 pages).
Farney, Robert J., et al., *The STOP-Bang Equivalent Model and Prediction of Severity of Obstructive Sleep Apnea: Relation to Polysomnographic Measurements of the Apnea/Hypopnea Index*, Journal of Clinical Sleep Medicine, vol. 7, No. 5, 2011, 459-467 (9 pages).
Finkel, Kevin J., et al., *Prevalence of Undiagnosed Obstructive Sleep Apnea Among Adult Surgical Patients in an Academic Medical Center*, Sleep Medicine 10 (2009) 753-758 (6 pages).
Finucane, Thomas E., *Evidence-Based Recommendations for the Assessment and Management of Sleep Disorders in Older Persons*, JAGS, Nov. 2009, vol. 57, No. 11, 2173-2174 (3 pages).
Fletcher, Eugene C., *"Near Miss" Death in Obstructive Sleep Apnea: A Critical Care Syndrome*, Critical Care Medicine, vol. 19, No. 9, Sep. 1991, 1158-1164 (7 pages).
Galhotra, Sanjay, *Mature Rapid Response System and Potentially Avoidable Cardiopulmonary Arrests in Hospital*, Qual. Saf. Health Care 2007, 16:260-265 (6 pages).
Gammon, Brian T. and Karen F. Ricker, *An Evidence-Based Checklist for the Postoperative Management of Obstructive Sleep Apnea*, Journal of PeriAnesthesia Nursing, vol. 27, No. 5 Oct. 2012, 316-322 (7 pages.).
Gay, Peter C., *Sleep and Sleep-Disordered Breathing in the Hospitalized Patient, Respiratory Care*, Sep. 2010, vol. 55, No. 9, 1240-1254 (15 pages).
Gay, Peter C., *The Value of Assessing Risk of Obstructive Sleep Apnea in Surgical Patients: It Only Takes One*, Journal of Clinical Sleep Medicine, vol. 6, No. 5, 2010, 473-474 (2 pages).
Global Industry Analysts, Inc., *GIA Market Report: Sleep Apnea Diagnostic and Therapeutic Devices, A Global Strategic Business Report, MCP-3307*, Oct. 2010, www.StrategyR.com, (321 pages).
Gibson, G. J., *Obstructive Sleep Apnoea Syndrome: Underestimated and Undertreated*, British Medical Bulletin 2004; 72: 49-64 (16 pages).
Gupta, Rakesh M., et al., *Postoperative Complications in Patients With Obstructive Sleep Apnea Syndrome Undergoing Hip or Knee Replacement: A Case-Control Study*, May Clin Proc. 2001; 76:897-905 (9 pages).
Guralnick, Amy S., et al., *CPAP Adherence in Patients with Newly Diagnosed Obstructive Sleep Apnea Prior to Elective Surgery*, Journal of Clinical Sleep Medicine, vol. 8, No. 5, 2012, 501-506 (6 pages).
Heinzer, Raphael C., et al., *Positional Therapy for Obstructive Sleep Apnea: An Objective Measurement of Patients' Usage and Efficacy at Home*, Sleep Medicine 13 (2012) 425-428 (4 pages).
Hoque, Enamul, et al., *Monitoring Body Positions and Movements During Sleep Using WISPs*, Wireless Health '10, Oct. 5-7, 2010 (10 pages).
Isono, Shiroh, et al., *Lateral Position Decreases Collapsibility of the Passive Pharynx in Patients with Obstructive Sleep Apnea*, Anesthesiology, vol. 97, No. 4, Oct. 2002, 780-785 (6 pages).
Itasaka, Yoshiaki and Kazuo Ishikawa, *The Influence of Sleep Position and Obesity on Sleep Apnea*, Psychiatry and Clinical Neurosciences (2000), 54, 340-341 (3 pages).
Jensen, Candice, et al., *Postoperative CPAP and BiPAP Use Can be Safely Omitted after Laparoscopic Roux-en-Y Gastric Bypass*, Surgery for Obesity and Related Diseases 4 (2008) 512-514 (3 pages).
Joho, Shuji, et al., *Impact of Sleeping Position on Central Sleep Apnea/Cheyne-Stokes Respiration in Patients with Heart Failure*, Sleep Medicine 11 (2010) 143-148 (6 pages).
Jokie, Ruzica, et al., *Positional Treatment vs. Continuous Positive Airway Pressure in Patients with Positional Obstructive Sleep Apnea Syndrome*, CHEST/115/3/Mar. 1999, 771-781 (11 pages).
Joosten, S.A., et al., *Obstructive Sleep Apnea Phenotypic Trait Changes from Supine to Lateral Position*, Am J Respir Crit Care Med 189; 2014; A3909 (1 page).
Joshi, Girish P., et al., *Society for Ambulatory Anesthesia Consensus Statement on Preoperative Selection of Adult Patients with Obstructive Sleep Apnea Scheduled for Ambulatory Surgery*, Anesthesia & Analgesia, Nov. 2012, vol. 115, No. 5, 1060-1068 (9 pages).
Keenan, Sean P., et al., *Clinical Practice Guidelines for the Use of Noninvasive Positive-Pressure Ventilation and Noninvasive Continuous Positive Airway Pressure in the Acute Care Setting*, Canadian Medical Association Journal, Feb. 22, 2011, 183(3) (21 pages).
Khayat, Rami, et al., *In-Hospital Resting for Sleep-Disordered Breathing in Hospitalized Patients with Decompensated Heart Failure: Report of Prevalence and Patient Characteristics, Journal of Cardiac Failure*, vol. 15, No. 9 (2009) (739-746).
Kim, Eun Joong, *The Prevalence and Characteristics of Positional Sleep Apnea in Korea*, Korean J Otorhinolaryngol-Head Neck Surg. 2009:52:407-12 (6 pages).
Kulkarni, Gaurav V., et al., *Obstructive Sleep Apnea in General Surgery Patients: Is it More Common than we Think?*, The American Journal of Surgery (2014) 207, 436-440 (5 pages).
Lakdawala, Linda, *Creating a Safer Perioperative Environment With an Obstructive Sleep Apnea Screening Tool*, Journal of PeriAnesthesia Nursing, vol. 26, No. 1 Feb. 2001, 15-24 (10 pages).

(56) References Cited

OTHER PUBLICATIONS

Lee, Chul Hee, et al., *Changes in Site of Obstruction in Obstructive Sleep Apnea Patients According to Sleep Position: A DISE Study*, Laryngoscope 00: Month 2014 (7 pages).
Lee, Jung Bok, et al., *Determining Optimal Sleep Position in Patients with Positional Sleep-Disordered Breathing Using Response Surface Analysis*, J. Sleep Res. (2009) 18, 26-35 (10 pages).
Lockhart, Ellen M., et al. *Obstructive Sleep Apnea Screening and Postoperative Mortality in a Large Surgical Cohort*, Sleep Medicine 14 (2013) 407-415 (9 pages).
Lynn, Lawrence A. and J. Paul Curry, *Patterns of Unexpected In-Hospital Deaths: A Root Cause Analysis*, Patient Safety in Surgery 2011, 5:3 (25 pages).
Mador, M. Jeffrey, et al., *Are the Adverse Effects of Body Position in Patients with Obstructive Sleep Apnea Dependent on Sleep Stage?*, Sleep Breath (2010) 14:13-17 (7 pages).
Mador, M. Jeffrey, et al., *Prevalence of Positional Sleep Apnea in Patients Undergoing Polysomnography*, CHEST 2005; 128:2130-2137 (8 pages).
Marcus, Howard, *Obesity and Postoperative Surgical Risk*, The Doctors Company, Third Quarter 2010, 1-8 (8 pages).
Martin-Du Pan, Rémy, et al., *The Role of Body Position and Gravity in the Symptoms and Treatment of Various Medical Diseases*, Swiss Med. Wkly. 2004: 134:543-551 (10 pages).
Memtsoudis, Stavros G., et al., *A Rude Awakening—The Perioperative Sleep Apnea Epidemic*, N Engl. J. Med. 368:25, 2352-2353 (Jun. 20, 2013) (2 pages).
Menon, Akshay and Manoj Kumar, *Influence of Body Position on Severity of Obstructive Sleep Apnea: A Systematic Review*, Otolaryngology, vol. 2013, Article ID 670381 (2013) (8 pages).
Mininni, Nicolette C., et al., *Pulse Oximetry: An Essential Tool for the Busy Med-Surg Nurse*, American Nurse Today, Nov./Dec. 2009, 31-33 (3 pages).
Mokhlesi, Babak, *Empiric Postoperative Autotitrating Positive Airway Pressure Therapy / Generating Evidence in the Perioperative Care of Patients at Risk for Obstructive Sleep Apnea*, CHEST 144/1 (Jul. 2013) 5-7 (3 pages).
Mull, Yvonne and Marshall Bedder, *Obstructive Sleep Apnea Syndrome in Ambulatory Surgical Patients*, AORN Journal, vol. 76, No. 3, 458-462 (Sep. 2002) (5 pages).
Nader, Nizar Z., et al., *Newly Identified Obstructive Sleep Apnea in Hospitalized Patients: Analysis of an Evaluation and Treatment Strategy*, Journal of Sleep Medicine, vol. 2, No. 4, 2006, 431-437 (7 Pages).
Pevernagie, Dirk A., et al., *Effects of Body Position on the Upper Airway of Patients with Obstructive Sleep Apnea*, Am J Respir Crit Care Med, vol. 152, 179-185, 1995 (7 pages).
Qureshi, Asher and Robert D. Ballard, *Obstructive Sleep Apnea*, J Allergy Clin Immunol, vol. 112, No. 4, 643-651 (2003) (9 pages).
Richard, Wietske, et al., *The Role of Sleep Position in Obstructive Sleep Apnea Syndrome*, Eur Arch Otorhinolaryngol (2006) 263:946-950 (5 pages).
Rocke, Daniel, et al., *Effectiveness of a Postoperative Disposition Protocol for Sleep Apnea Surgery*, American Journal of Otolaryngology—Head and Neck Medicine and Surgery 34 (2013) 273-277 (5 pages).
Gabbott, D.A., *The Effect of Single-Handed Cricoid Pressure on Neck Movement After Applying Manual In-Line Stabilisation*, Anaesthesia, 1997, 52, 586-602 (17 pages).
Ross, Jacqueline, *Obstructive Sleep Apnea: Knowledge to Improve Patient Outcomes*, Journal of PeriAnesthesia Nursing, vol. 23, No. 4 (August), 2008, 273-275 (3 pages).
Setaro, Jill, *Obstructive Sleep Apnea: A Standard of Care That Works*, Journal of PeriAnesthesia Nursing, vol. 27, No. 5 (October), 2012, 323-328 (6 pages).
Sheldon, Alison, et al., *Nursing Assessment of Obstructive Sleep Apnea in Hospitalised Adults: A Review of Risk Factors and Screening Tools*, Contemporary Nurse, vol. 34, Issue 1, Dec. 2009/Jan. 2010, 19-33 (16 pages).
Skinner, Margot A., et al., *Efficacy of the Tennis Ball Technique' Versus nCPAP in the Management of Position-Dependent Obstructive Sleep Apnoea Syndrome*, Respirology (2008) 13, 708-715 (8 pages).
Stearns, Joshua D. and Tracey L. Stierer, *Peri-Operative Identification of Patients at Risk for Obstructive Sleep Apnea*, Seminars in Anesthesia, Perioperative Medicine and Pain (2007) 26, 73-82 (10 pages).
Van Kesteren, Ellen R., et al., *Quantitative Effects of Trunk and Head Position on the Apnea Hypopnea Index in Obstructive Sleep Apnea*, SLEEP, vol. 34, No. 8 (2011), 1075-1081 (7 pages).
Veasey, Sigrid C., et al., *Medical Therapy for Obstructive Sleep Apnea: A Review by the Medical Therapy for Obstructive Sleep Apnea Task Force of the Standards of Practice Committee of the American Academy of Sleep Medicine*, SLEEP, vol. 29, No. 8 (2006), 1036-1044 (9 pages).
Wolfson, Alexander, et al., *Postoperative Analgesia for Patients with Obstructive Sleep Apnea Syndrome*, Seminars in Anesthesia, Perioperative Medicine and Pain (2007), 26, 103-109 (7 pages).
Yantis, Mary Ann, *Decreasing Surgical Risks for Patients with Obstructive Sleep Apnea*, AORN Journal, vol. 68, No. 1 (Jul. 1998), 50-55 (6 pages).
Ravesloot, M.J.L., and N. de Vries, *Reliable Calculation of the Efficacy of Non-Surgical Treatment of Obstructive Sleep Apnea Revisted*, SLEEP, vol. 34, No. 1 (2011), 105-110 (6 pages).
Moon, Il Joon, et al., *Sleep Magnetic Resonance Imagine as a New Diagnostic Method in Obstructive Sleep Apnea Syndrome*, Laryngoscope 120: Dec. 2010, 2546-2554 (9 pages).
Nepomnayshy, Dmitry, et al., *Sleep Apnea: Is Routine Preoperative Screening Necessary?*, OBES Surg. (2013) 23:287-192 (5 pages).
Press Release: *World's Leading Health Media Promotes Disinformation on Best Sleeping Positions* (Sep. 22, 2010), Sleeping Positions Research Summary (24 Studies), http://www.normalbreathing.com/I-6-best-sleep-positions.php (14 pages).
Oksenberg, Arie, et al., *Association of Body Position with Severity of Apneic Events in Patients with Severe Nonpositional Obstructive Sleep Apnea*, CHEST 2000; 118; 1018-1024 (9 pages).
Oksenberg, Arie, *The Avoidance of the Supine Posture during Sleep for Patients with Supine-related Sleep Apnea*, BSM Protocols for Adherence and Treatment of Intrinsic Sleep Disorders, Chapter 23, 223-236 (14 pages).
Oksenberg, Arie and Donald Silverberg, *The Effect of Body Posture on Sleep-Related Breathing Disorders: Facts and Therapeutic Implications*, Sleep Medicine Reviews, vol. 2, No. 3, 139-162 (1998) (25 pages).
Oksenberg, Arie, et al., *Positional Therapy for Obstructive Sleep Apnea Patients: A 6-Month Follow-Up Study*, Laryngoscope 116, Nov. 2006, 1995-2000 (6 pages).
Oksenberg, Arie, et al., *REM-Related Obstructive Sleep Apnea: The Effect of Body Position*, Journal of Clinical Sleep Medicine, vol. 6, No. 4 (2010), 343-348 (6 pages).
Ozeke, Ozcan, et al., *Influence of the Right- Versus Left-Sided Sleeping Position on the Apnea-Hypopnea Index in Patients with Sleep Apnea*, Sleep Breath, published online Jun. 16, 2011 (5 pages).
Ozeke, Ozcan, et al., *Sleep Apnea, Heart Failure, and Sleep Position*, Sleep Breath, published online Nov. 9, 2011 (4 pages).
Permut, Irene, et al., *Comparison of Positional Therapy to CPAP in Patients with Positional Obstructive Sleep Apnea*, Journal of Clinical Sleep Medicine, vol. 6, No. 3 (2010), 238-243 (6 pages).
Author Unknown, *Positioning of Surgical Patients With Sleep Apnea*, ClinicalTrials.gov, http://clinicaltrials.gov/ct2/show/NCT02123238?term=apnea+and+position&rank=3 (2014) (5 pages).
Author Unknown, *Obstructive Sleep Apnea May Block the Path to a Positive Postoperative Outcome*, 2007 Pennsylvania Patient Safety Authority, reprinted from the PA-PSRS Patient Safety Advisory, vol. 4, No. 3 (Sep. 2007) (9 pages).
Proczko, Monika, et al., *STOP-Bang and the Effect on Patient Outcome and Length of Hospital Stay when Patients are not Using Continuous Positive Airway Pressure*, J Anesth, published online May 29, 2014 (7 pages).

(56) References Cited

OTHER PUBLICATIONS

Ramachandran, Satya Krishna, et al., *Derivation and Validation of a Simple Perioperative Sleep Apnea Prediction Score*, Society for Ambulatory Anesthesiology, vol. 110, No. 4 (Apr. 2010), 1007-1015 (9 pages).
Ravesloot, M.J.L. and N. de Vries, *Calculation of Surgical and Non-Surgical Efficacy for OSA / Reliable Calculation of the Efficacy of Non-Surgical and Surgical Treatment of Obstructive Sleep Apnea Revisted*, vol. 34, Issue 01 (2001) 105-110 (2 pages).
Ravesloot, M.J.L., et al., *The Undervalued Potential of Positional Therapy in Position-Dependent Snoring and Obstructive Sleep Apnea—A Review of the Literature*, Sleep Breath, published online Mar. 24, 2012 (11 pages).
Ravesloot, Madeline J.L., et al., *Treatment Adherence Should be Taken into Account when Reporting Treatment Outcomes in Obstructive Sleep Apnea*, Sleep Medicine, vol. 124, Issue 1 (Jan. 2014) 344-345 (3 pages).
Richardson, Annette and Anne Killen, *How Long do Patients Spend Weaning from CPAP in Critical Care?*, Intensive and Critical Care Nursing (2006) 22, 206-213 (8 pages).
Rosenberg, Russell and Paul Doghramji, *Optimal Treatment of Obstructive Sleep Apnea and Excessive Sleepiness*, Springer Healthcare Communication, published online Apr. 3, 2009, 295-312 (18 pages).
Rosenthal, Leon, *Got CPAP? Use it in the Hospital!*, Sleep Breath, published online Nov. 25, 2011 (4 pages).
Safiruddin, Faiza, et al., *Analysis of the Influence of Head Rotation During Drug-Induced Sleep Endoscopy in Obstructive Sleep Apnea*, Laryngoscope 124: Sep. 2014, 2195-2199 (5 pages).
Seet, Edwin and Frances Chung, *Obstructive Sleep Apnea: Preoperative Assessment*, Anesthesiology Clin 28 (2010) 199-215 (17 pages).
Seet, Edwin, et al., *Perioperative Clinical Pathways to Manage Sleep-Disordered Breathing*, Sleep Med Clin 8 (2013) 105-120 (16 pages).
Sforza, Emilia, et al., *A 3-Year Longitudinal Study of Sleep Disordered Breathing in the Elderly*, European Respiratory Journal, vol. 40, No. 3 (2012) 665-672 (8 pages).
Sforza, E., et al., *Natural Evolution of Sleep Apnoea Syndrome: A Five Year Longitudinal Study*, European Respiratory Journal, 1994, 7, 1765-1770 (6 pages).
Shafazand, Shirin, *Perioperative Management of Obstructive Sleep Apnea: Ready for Prime Time?*, Cleveland Clinic Journal of Medicine, vol. 76, Supp. 4, Nov. 2009 (6 pages).
Siddiqui, Fouzia, et al. *Half of Patients with Obstructive Sleep Apnea have a Higher NREM AHI than REM AHI*, Sleep Medicine 7 (2006) 281-285 (5 pages).
Singh, M., et al., *Proportion of Surgical Patients with Undiagnosed Obstructive Sleep Apnoea*, British Journal of Anaesthesia 110 (4); 629-636 (2013) (8 pages).
Skinner, Margot A., et al., *Elevated Posture for the Management of Obstructive Sleep Apnea*, Sleep and Breathing, vol. 8, No. 4 (2004) 193-200 (10 pages.).
Author Unknown, *There's More than One Way to Improve Nightime Breathing*, European Sleep Works, http://www.sleepworks.com/resource/medical-needs/sleep-apnea (2014) (3 pages).
Park, Steven V., *Sleep Apnea CPAP Compliance Craziness*, Doctor Steven Y_ Park, MD New York, NY Integrative Solutions for Obstructive Sleep Apnea, Upper Airway Resistance Syndrome, and Snoring (Nov. 10, 2009) (7 pages).
Monk, Timothy H., et al., *Measuring Sleep Habits Without Using a Diary: The Sleep Timing Questionnaire*, SLEEP, vol. 26, No. 2 (2003) 208-212 (5 pages).
Sorscher, Adam J. and Evan M. Caruso, *Frequency of Provision of CPAP in the Inpatient Setting: An Observational Study*, Sleep Breath, published online Nov. 23, 2011 (6 pages).
Spurr, Kathy F., et al., *Prevalence of Unspecified Sleep Apnea and the use of Continuous Positive Airway Pressure in Hospitalized Patients, 2004 National Hospital Discharge Survey*, Sleep Breath (2008) 12:229-234 (8 pages).
Srijithesh PR, et al., *Positional Therapy for Obstructive Sleep Apnoea (Protocol)*, The Cochrane Library 2014, Issue 2 (11 pages).
Sundar, Eswar, et al., *Perioperative Screening for the Management of Patients with Obstructive Sleep Apnea*, JCOM, vol. 18, No. 9, Sep. 2011, 399-411 (13 pages).
Szollosi, Irene, et al., *Lateral Sleeping Position Reduces Severity of Central Sleep Apnea/Cheyne-Stokes Respiration*, SLEEP, vol. 29, No. 8 (2006), 1045-1051 (7 pages).
Author Unknown, *A Promising Concept of Combination Therapy for Positional Obstructive Sleep Apnea*, Springer Link, http://link.springer.com/article/10.1007/s11325-014-1068-8, Oct. 2014 (4 pages).
Author Unknown, *Upper Airway Collapse During Drug Induced Sleep Endoscopy: Head Rotation in Supine Position Compared with Lateral Head and Truck Position*, Springer Link, http://link.springer.com/article/10.1007/s00405-014-3215-z, Aug. 2014 (4 pages).
Vasu, Tajender S., et al., *Obstructive Sleep Apnea Syndrome and Postoperative Complications*, Arch Otolaryngol Head Neck Surg, vol. 136, No. 10, Oct. 2010 (5 pages).
Matthews, Dan, Mattresses—*A Futile Weapon in the Fight Against Sleep Apnea*, http://www.danmatthewsdds.com/mattresses-%E2%80%93-futile-weapon-fight-sleep-apnea/ (2014) (1 page).
Marks, Steve, *Hospital Care of Patients with Sleep Apnea*, Areté Sleep Health, last modified on May 16, 2013 (63 pages).
Carlisle, Heather, *The Case for Capnography in Patients Receiving Opioids*, American Nurse Today, vol. 9, No. 9 (Sep. 2014) 22-27 (69 pages).
Gold, Jenny, *The Sleep Apnea Business is Booming, and Insurers Aren't Happy*, NPR_ApnesvsInsurers.mht, (Jan. 16, 2012) (3 page).
Author unknown, *Sleep right, Sleep tight, Natural sleep before medicines, Sleep Diary*, www.nps.org.au/sleep, last modified Jul. 7, 2010 (4 pages).
Quan, S. F., *Evolution of OSA*, Thorax 1998; 53:532 (4 pages).
Maurer, J. T., et al., *Treatment of Obstructive Sleep Apnea with a New Vest Preventing the Supine Position*, Thieme-Connect (2003) (1 page).
Schreuder, K.E., *The Effect of Cervical Positioning on Benign Snoring by Means of a Custom-Fitted Pillow*, Centre for Sleep and Wake Disorders Kempenhaeghe, 5591 Ve Heeze, the Netherlands, last modified Dec. 1, 2011 (4 pages).
Chung, Frances, *Semi-up Right Position Study*, Clinical Trials.gov, last updated May 28, 2014 (5 pages).
Author Unknown, *National Sleep Foundation Sleep Diary*, National Sleep Foundation, last modified Apr. 18, 2003 (2 pages).
Takaoka, Shanon, CPAP Adherence, Is it too much "pressure"?, Feb. 7, 2007 (41 pages).
Seren, Suaf, *The Effect of Pure Prone Positioning Therapy for the Patients With Mild to Moderate Obstructive Sleep Apnea*, ClinicalTrials.gov, last updated Jun. 7, 2011 (4 pages).
Jackman, Shawn M. and Bruce Hubbert, *Riding the Wireless Wave (without wiping out)*, HIMSS12 Annual Conference & Exhibition, last modified Feb. 20, 2012 (133 pages).
De Vries, Nico and Madeline Ravesloot, *Apnea Calculator*, http://apneacalculator.com (2014) (2 pages).
Oexman, Robert, *Can a Mattress Really Impact Your Sleep?*, Huffpost Healthy Living, Posted Oct. 14, 2012, 10:00 a.m. (8 pages).
Palmer, Laura and Suzanne R. Morrison, *Obesity and Obstructive Sleep Apnea /Is there a limit for ambulatory surgery?*, OR Nurse Journal, Sep. 2014 (9 pages).
Oksenberg, Arie, *Are We Missing a Simple Treatment for Most Adults Sleep Apnea Patients? The Avoidance of the Supine Sleep Position*, ResearchGate.net, Aug. 12, 2014 (2 pages).
Author Unknown, *Obstructive Sleep Apnea (OSA), Care of Adult Patients*, St. Anthony Central Hospital Clinical Standards, Jul. 8, 2009 (9 pages).
PCT Search Report and Written Opinion for PCT/US2014/18033, completed Aug. 18, 2014 (17 pages).
O'Connor, Anahad, *Treating Sleep Apnea Without the Mask*, NYTimes.com, Apr. 9, 2012 (7 pages).
Stradling, J. R. and R. J. O. Davies, *Sleep 1: Obstructive Sleep Apnea/Hypopnoea Syndrome: Definitions, Epidemiology, and Natural History*, Thorax 2004;59:73-78 (6 pages).

(56) References Cited

OTHER PUBLICATIONS

Pyke, Josh, et al, *Continuous Pulse Oximetry Monitoring in the Inpatient Population*, Patient Safety & Quality Healthcare, May/Jun. 2009 (5 pages).
EP Search Report for Application No. EP 13 79 3571, dated Sep. 8, 2015 (9 pages).
Service Manual—"TotalCare® Bed System" from Hill-Rom, Product No. P1900, MAN112 REV 7, by Hill-Rom Services, Inc. (2007) (1105 pages).
User Manual—"TotalCare® Bed System" from Hill-Rom, Product No. P1900, USR042 REV11, by Hill-Rom Services, Inc. (2009) (112 pages).
PCT Search Report for PC5T/US2013/042313, completed Dec. 6, 2013 (4 pages).
SleepEducation—Blog, "Positional therapy harness helps reduce sleep apnea for some," www.sleepeducation.com, posted Friday, Jun. 18, 2010 (7 pages).
SPANAmerica: PressureGuard® Turn Select®, www.archive.org/web/20090201172625/http://spanamerica.com/turn_select.php; Aug. 18, 2014 (2 pages).

* cited by examiner

SLEEP DISORDER TREATMENT DEVICES, SYSTEMS, AND METHODS

The present application claims the benefit, under 35 U.S.C. § 119(e), of U.S. Provisional Application No. 62/300,340, which was filed Feb. 26, 2016 and which is hereby incorporated by reference herein in its entirety.

BACKGROUND

This disclosure relates generally to systems, methods, and devices for the treatment of sleep disorders. More particularly, but not exclusively, the present disclosure relates to mattresses having features and functions that aid in the treatment of sleep disorders. While various systems have been developed, there is still room for improvement. Thus, a need persists for further contributions in this area of technology.

SUMMARY

A system, method or apparatus according to this disclosure may comprise one or more of the features recited in the appended claims and/or the following features which, alone or in any combination, may comprise patentable subject matter:

According to one embodiment of the present disclosure, a sleep disorder treatment system is provided comprising a mattress may have a longitudinal length defined by a longitudinal axis of the mattress when the mattress is in its most horizontal position and a lateral width defined by a lateral axis of the mattress when the mattress is in its most horizontal position. The mattress includes a head section having a head support surface to support at least a portion of a person's head. At least a portion of the head support surface is generally sloped in the lateral direction at an angle relative the lateral axis, wherein the angle of the head support surface is from about 10 degrees to about 30 degrees. The mattress also includes a torso section having a torso support surface to support at least a portion of a person's torso, wherein the torso support surface is generally sloped in the lateral direction at an angle relative to the lateral axis, and comprises a cradle surface extending downwardly and laterally from near one side of the torso support section to an opposite side of the torso support section.

According to another embodiment of the present disclosure, a sleep system for supporting a person is provided having a lateral width and longitudinal length and a top surface. The system comprises a first turn bladder, a first flexible pate provided on top of at least a portion of the first turn bladder, a second turn bladder laterally spaced from the first turn bladder. At least a portion of the first flexible plate is positioned on top of the second turn bladder. The system further comprises a second flexible plate positioned on top of at least a portion of the second turn bladder, and an air control system including an air source. The air control system is configured to selectively deliver air to the first turn bladder and the second turn bladder to cause the sleep system to tilt laterally right or laterally left. The flexible plates flex when under top load and the sleep system is laterally tilted.

According to another embodiment of the present disclosure, a sleep system is provided comprising a head support section, a torso support section, a leg support section, and a cradle surface provided on at least an upper portion of the torso support section. The head support section is generally laterally angled at an angle greater than the lateral angle of the torso support section and the leg support section. In some embodiments, the cradle surface has at least a partial curvature and a lateral width of from about 12 inches to about 36 inches. In some embodiments, lateral angle of the head support section is at least about 10 degrees.

Additional features and embodiments, that alone or in combination with any other features of any other embodiments, including those listed above and those listed in the claims, and those described in detail below, may comprise patentable subject matter. Other features and embodiments will become apparent to those skilled in the art upon consideration of the following detailed description of illustrative embodiments. Any feature or aspect disclosed herein, or any embodiment disclosed herein, can be combined with any other feature or aspect or embodiment disclosed herein. One or more features of any embodiment disclosed herein can be combined with one or more features of any other embodiment disclosed herein, and other features can be removed or added to create still further embodiments. Accordingly, many other features, aspects, and embodiments are possible without departing from the spirit, scope, and principles of the present disclosure.

BRIEF DESCRIPTION OF THE DRAWINGS

Referring now to the illustrative examples in the drawings, wherein like numerals represent the same or similar elements throughout.

DETAILED DESCRIPTION

Figure 1:
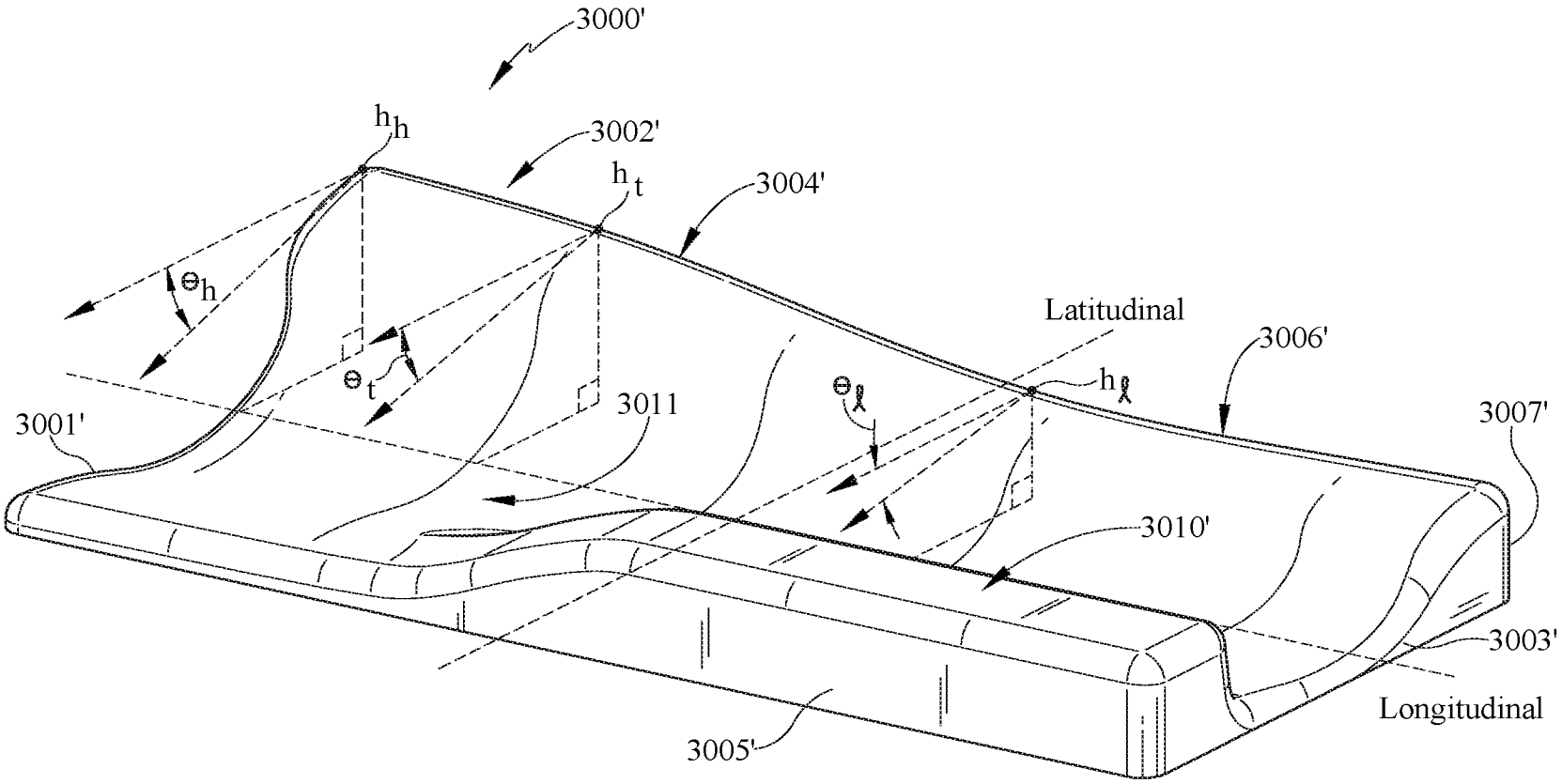
FIG. 1 is a top, foot end, perspective view of a mattress according to one embodiment of the present disclosure.
Figure 2:
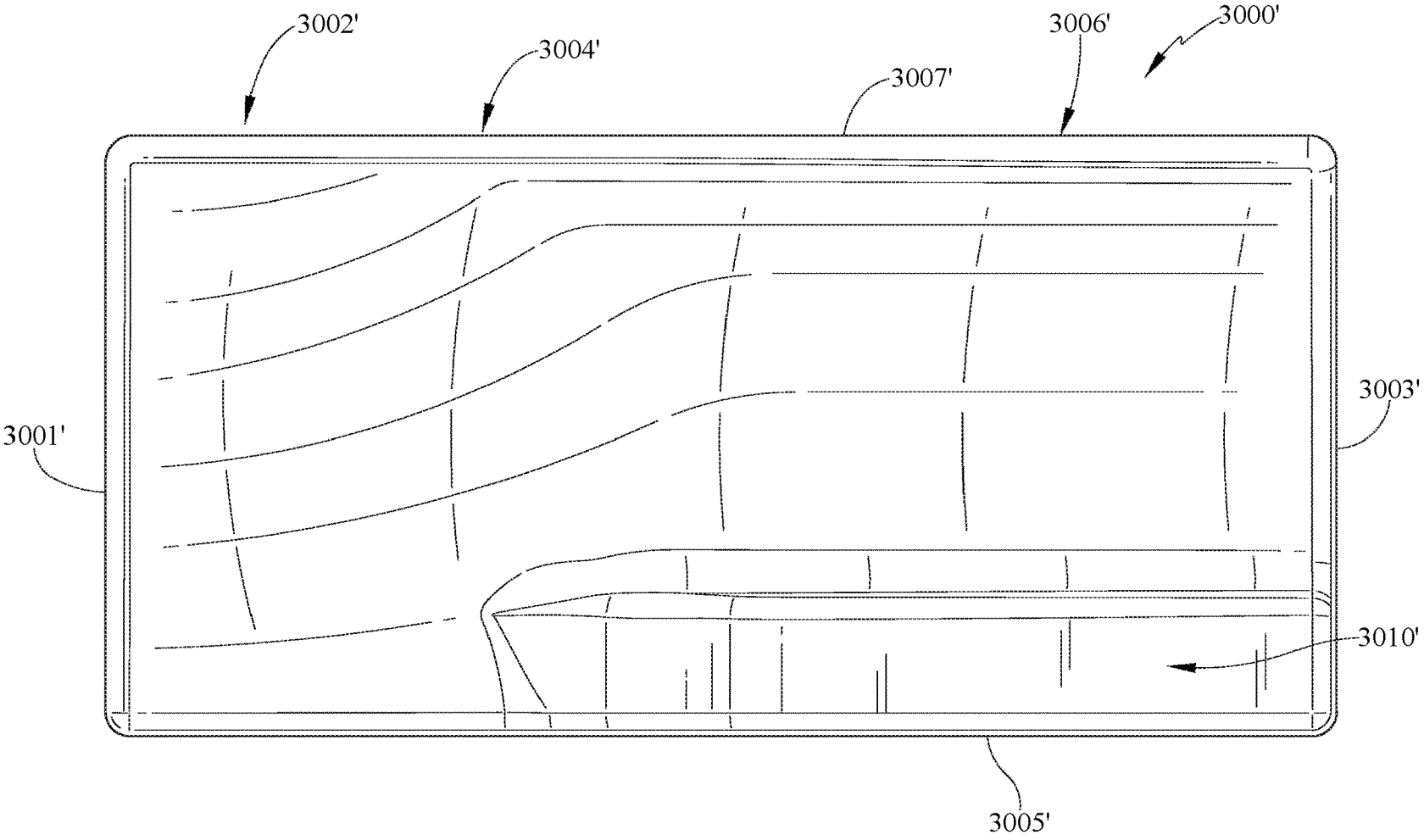
FIG. 2 is a top plan view of the mattress of FIG. 1.
Figure 3:
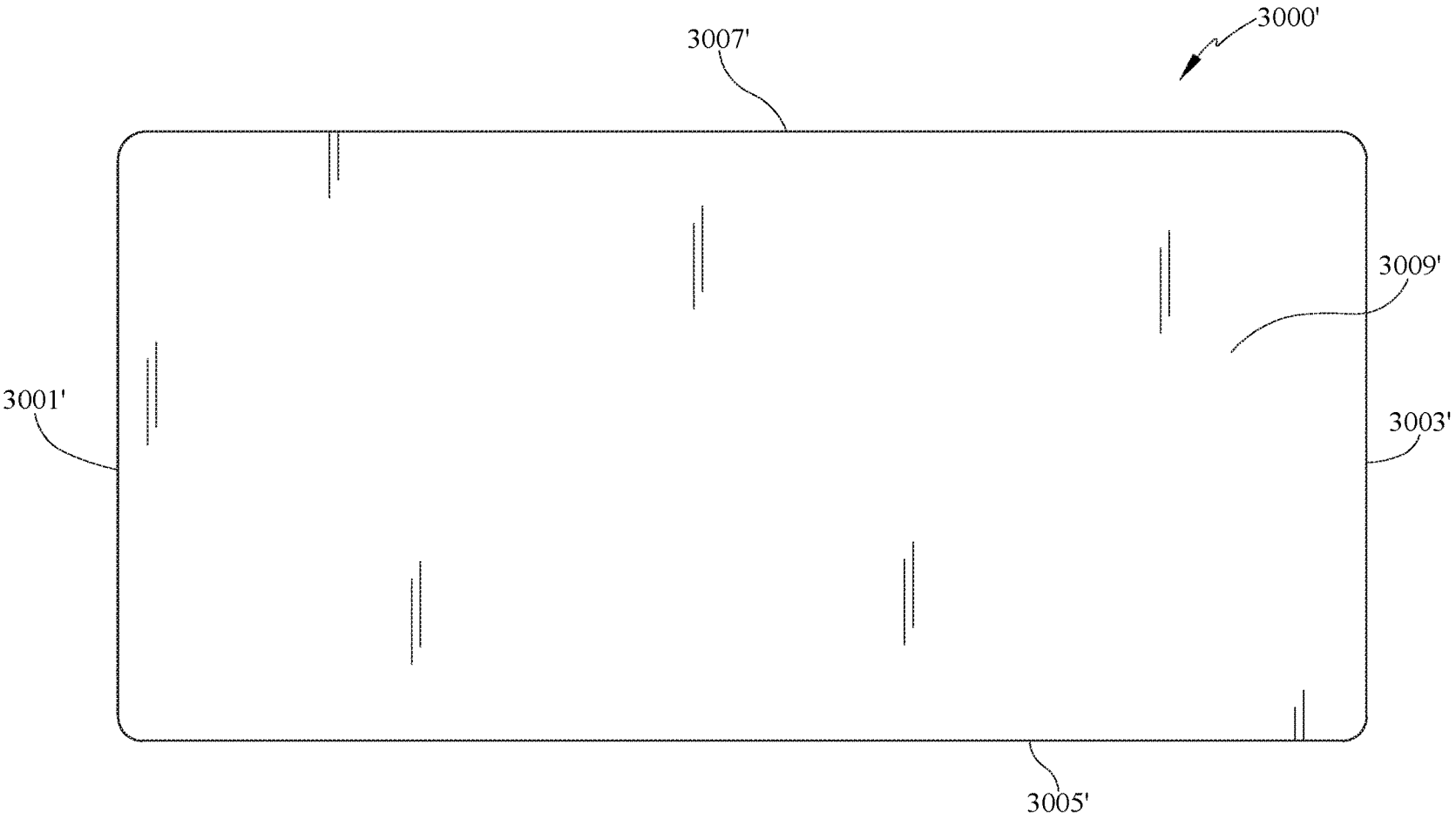
FIG. 3 is a back plan view of the mattress of FIG. 1.
Figure 4:
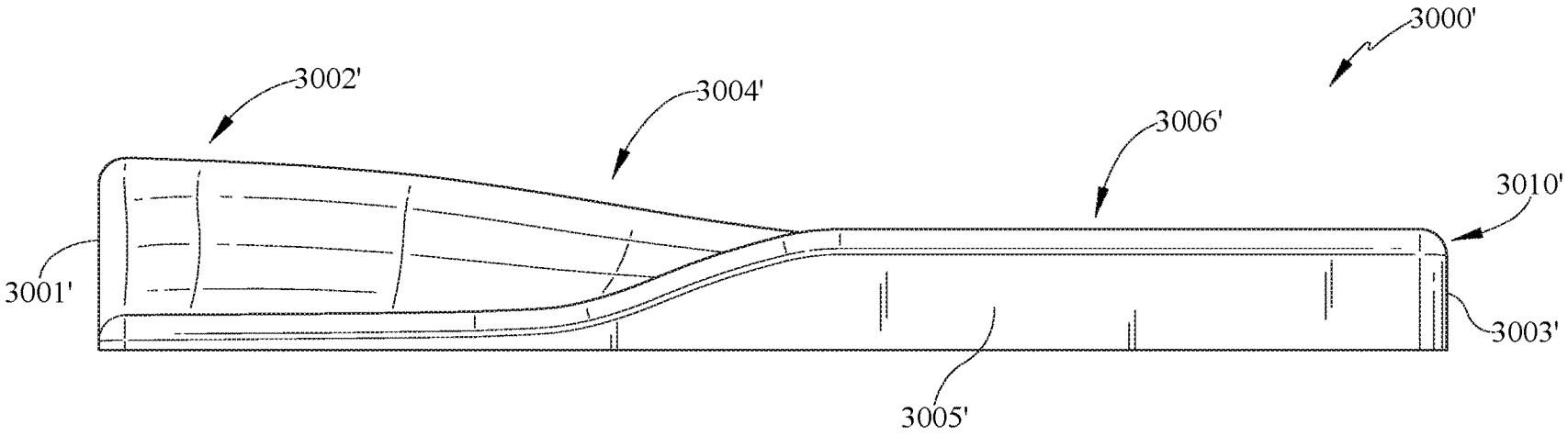
FIG. 4 is a first side elevation view of the mattress of FIG. 1.
Figure 5:
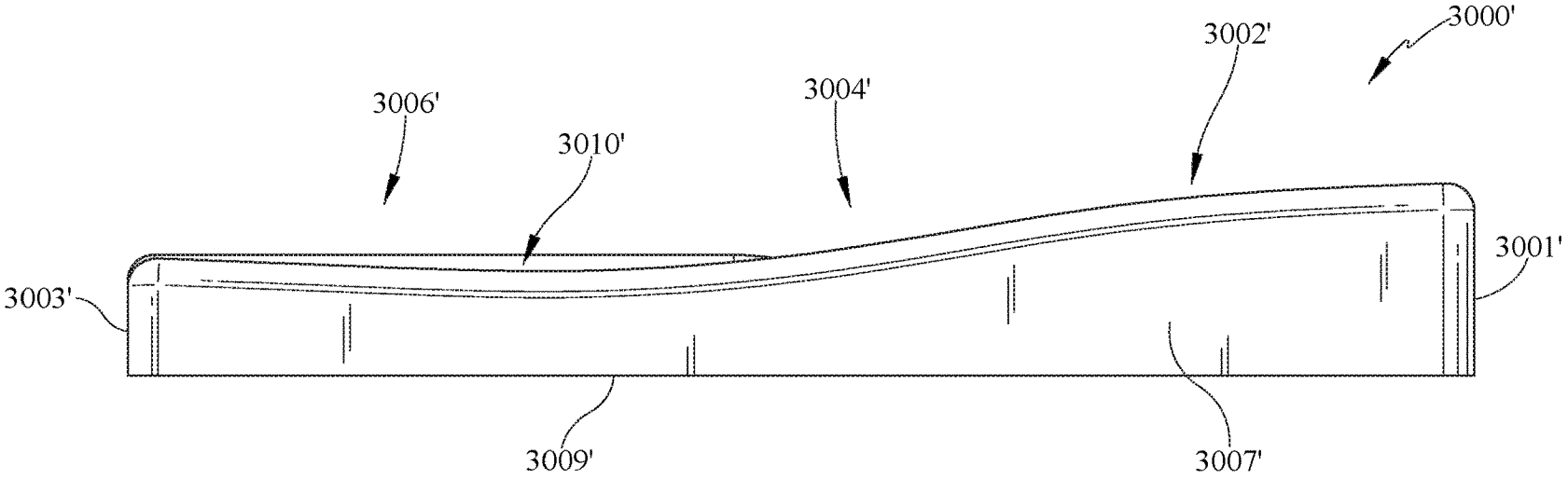
FIG. 5 is a second side elevation view of the mattress of FIG. 1.
Figure 6:
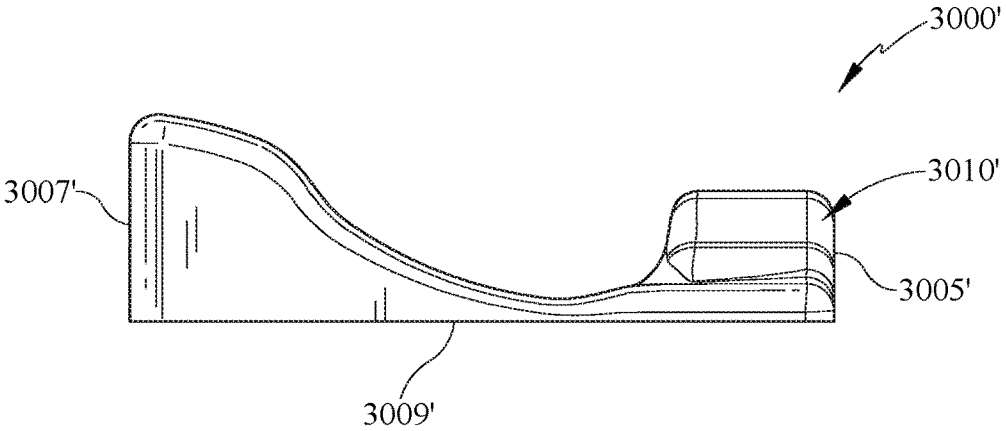
FIG. 6 is a head end elevation view of the mattress of FIG. 1.
Figure 7:
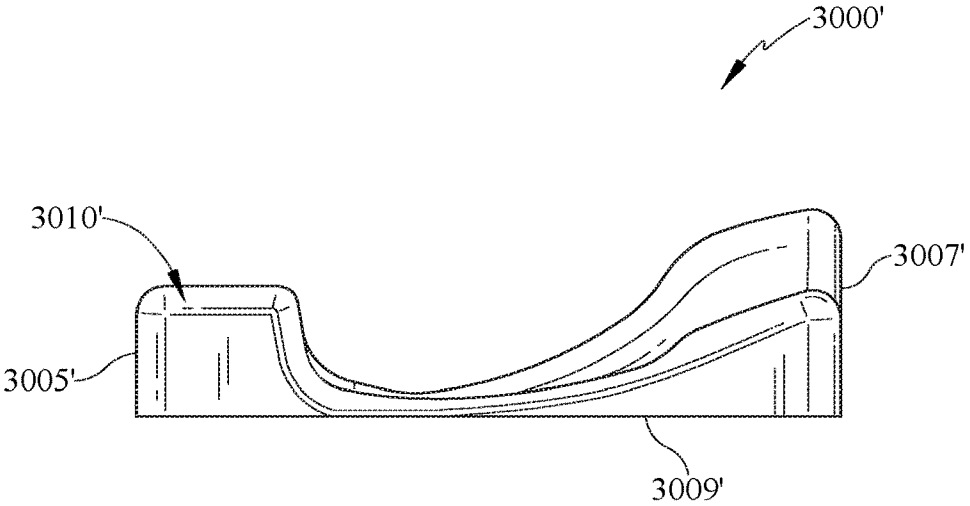
FIG. 7 is a foot end elevation view of the mattress of FIG. 1.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

FIGS. 1-7 depict an illustrative embodiment of the present disclosure. In this embodiment, the sleep apparatus is in the form of a mattress 3000' having a head support section 3002', a torso support section 3004', and a leg support section 3006'. Additionally, the mattress 3000' of this embodiment includes a bolster 3010'. The head support section 3002', torso support section 3004', leg support section 3006', and bolster 3010' are all made of one or more layers of foam in this embodiment. Other, or additional, fabric materials can be utilized however, and the top layer of the mattress 3000' can comprise a viscoelastic foam, a cover fabric, fire barrier, casing, and/or ticking material. The mattress 3000' includes a head end 3001', a foot end 3003', a right side 3005', a left side 3007', a longitudinal central axis and a lateral (or latitudinal) central axis. In this embodiment, the vertical support sections of the mattress 3000' is generally slope downwardly in both the lateral direction and in the longitudinal direction. In this example, the sloping occurs in a curved manner in both directions, rather than in a linear or stepped manner (although other embodiments may include other sloping, such as linear, curved, and/or stepped sloping for example).

Each of the sloped lying (person support) sections 3002', 3004', and 3006' include a maximum height. In this example, the head section has a maximum height $h_h$, the torso section has a maximum height $h_t$, and the leg section has a maximum height $h_1$, and $h_h$ is greater than $h_t$ which is greater than $h_1$. In some embodiments, there may be irregularly shaped portions of these sections 3002', 3004', and 3006', but the average heights of these sections (taken for example by averaging the maximum heights of all lateral cross sections of each section) are generally different from one another. For example, in one embodiment, the average height of the head section is at least about 20% larger than the average height of the torso section, and the average height of the torso section is at least about 20% larger than the average height of the leg section. Accordingly, the vertical support sections of the mattress 3000' slope generally downwardly in the longitudinal direction from the head end 3001' to the foot end 3003'.

Additionally, in this embodiment, the person support sections of the mattress 3000' slope generally downwardly in the lateral direction from the left side 3007' toward the right side 3005'. Accordingly, the maximum slope of each of the sections (defined by the tangents to the curves at the highest points $h_t$, $h_h$, and $h_1$) relative to horizontal, is indicated by the angles $\Theta_h$, $\Theta_t$, and $\Theta_1$. In this embodiment $\Theta_h$ is greater than $\Theta_t$ which in turn is greater than $\Theta_1$. In other words, the lateral slope of the head section 3002' is generally greater than the lateral slope of the torso section 3004', and the lateral slope of the torso section 3004' is generally greater than the lateral slope of the leg section 3006'. These angles $\Theta_h$, $\Theta_t$, and $\Theta_1$ of slope could, alternatively, be determined by determining the average slope of lateral cross sections of each section 3002, 3004, and 3006'.

In this embodiment, angle $\Theta_h$, is about 25 degrees, $\Theta_t$, is about 17.5 degrees, and $\Theta_1$ is about 10 degrees. In some embodiments, the angle $\Theta_h$ is from about 10 to about 30 degrees, and the angle $\Theta_t$ is from about 0 to about 25 degrees (such as from about 1 to about 20 degrees). In some embodiments, angle $\Theta_h$ is at least about 20 degrees, such as from about 20 to about 25 degrees, and the angle $\Theta_t$ is at least about 10 degrees, such as from about 10 to about 25 degrees.

Furthermore, in some embodiments, the angle $\Theta_t$ is from about 5 to about 15 degrees less than the angle $\Theta_h$. In some embodiments, the angle $\Theta_t$ is from about 5 to about 10 degrees less than the angle $\Theta_h$, and in some embodiments the angle $\Theta_t$ is about 7.5 degrees less than the angle $\Theta_h$. In some embodiments, the angle $\Theta_t$ is from about 15 to about 17.5 degrees.

Moreover, in some embodiments, the angle $\Theta_1$ is from about 0 degrees to about 15 degrees. In some embodiments, the angle $\Theta_1$ is from about 0 degrees to about 12.5 degrees, and in some embodiments is about 10 degrees. In some embodiments, the angle $\Theta_1$ is from about 0 to about 15 degrees less than the angle $\oplus_t$. In some embodiments, the angle $\Theta_1$ is from about 5 to about 10 degrees less than the angle $\Theta_t$, and in some embodiments the angle $\Theta_1$ is about 7.5 degrees less than the angle $\Theta_t$.

As shown in FIGS. 1-7, the sleep apparatus in this embodiment includes a cradle surface 3011 that extends laterally across the mattress 3000' in the areas of the head support section 3002' and torso support section 3004'. In this embodiment, the cradle surface comprises a generally concave open portion that extends generally downwardly into the mattress material 3000'. The concave portion can generally mimic the lateral curvature of the mid portion of the human back. In some embodiments, the cradle surface extends laterally for at least about 12 inches, such as from about 12 inches to about 36 inches. In some embodiments, the radius of curvature of the curve is from about 5 inches to about 100 inches, such as from about 7 inches to about 50 inches for example, or about 10 to about 40 inches, for example.

In use, the mattress 3000' can be placed on a bed frame, floor, existing bed or mattress, cot, platform, or other support. The user lies on the top surfaces with the head section surface 3002' generally supporting the user's head, the torso section surface 3004' generally supporting the user's torso, and the leg section surface 3006' generally supporting the user's legs. Due to the angle eh of the head support section 3002', the side of the user's head is urged to lie at a significant angle (e.g., plus or minus about 35 degrees or more relative to vertical). In this embodiment, in use, a straight line along the approximate surface of the user's face from the ear toward the eye will often lie at an angle (or the plane defined generally by the centerline of the nose), will be at an angle or offset from the vertical up direction and vertical plane. In some embodiments, regardless if the patient is being supported on the patient's back, front, or side, and regardless of whether the patient is sleeping with the face pointed "uphill" relative to the top surface of the mattress 3000' or pointed "downhill" relative to the top surface, the face is urged to a left or right angle and away from looking straight up to the ceiling, when the mattress 3000' is in the generally horizontal position. In some embodiments, this urging is to an angle that is 35 degrees or more left or right of the plane that the nose centerline would point if the patient had the nose/face/eyes square with the ceiling, pointing straight ahead. The face can be urged to an angle similar to the lateral plane angle of the top surface of mattress 3000' (or at least to an angle perpendicular thereto), and certain sleep disorders, such as sleep apnea, may be reduced. In some embodiments, the patient is urged by the surfaces to sleep in a position wherein the soft tissues (e.g., the soft pallet, tongue, uvula, tonsils, pharynx, and/or adenoids) in the upper respiratory tract are at a significant angle relative to the vertical down direction, and/or are less restrictive of the breathing passages so as to minimize apnea events. In some embodiments, because the patient's head twists due to the angled surfaces, torsion is created in the muscles and/or tissues in the neck. This may increase the rigidity of the airway and thereby prevent closing of the upper respiratory tract, reducing possibility of apnea. In this embodiment of FIG. 1, because the mattress has an angled top surface where the angle gradually reduces angle from head end to foot end, it has been found that tolerability/comfort of the mattress 3000' for sleeping can be improved. Because the mattress 3000' is made of a flexible material (which is a foam material in this embodiment) when placed on a support deck or frame with a pivoting or raisable leg and/or thigh portion, the leg section 3006' can be pivoted relative to the torso section 3004', to thereby create a raised knee and/or thigh, and/or a knee gatch or knee bed in the patient. In some embodiments, this configuration can help resist the migration of the patient toward the foot end and maintain the head in an angled position similar. Furthermore, in this embodiment, the height $h_h$ of the head support surface 3002' is generally greater than the longitudinally corresponding height $h_t$ of the torso support surface 3004', which is generally greater than the longitudinally corresponding height $h_1$ of the leg support surface 3006', so as to create a longitudinal slope on the mattress as well, and causing the body to slope slightly longitudinally downwardly during sleep as well.

The cradle surface 3011 assists in resisting movement of the patient from the desired position on the mattress 3000' to thereby help maintain the patient's head in the desired position for as long as possible during sleep, and/or to increase perceived comfort and stability of the mattress 3000'. The bolster 3010' of this embodiment likewise assists in resisting movement of the patient from the desired position. In this embodiment, the cradle surface 3011 is formed by forming the top surface of the foam mattress 3000' in the desired shape. However, other embodiments are possible, such as by using side members, or by using solid interior plates, as will be described in more detail below with respect to some embodiments. Additionally, the top surface of the mattress 3000', and the other mattresses described herein, can be covered with a thin layer of quilting or a fabric material, and/or with a visco-elastic foam material, for additional comfort (and/or to assist in maintaining the person in the desired sleeping position for as long as possible during sleep.)

Figure 8:
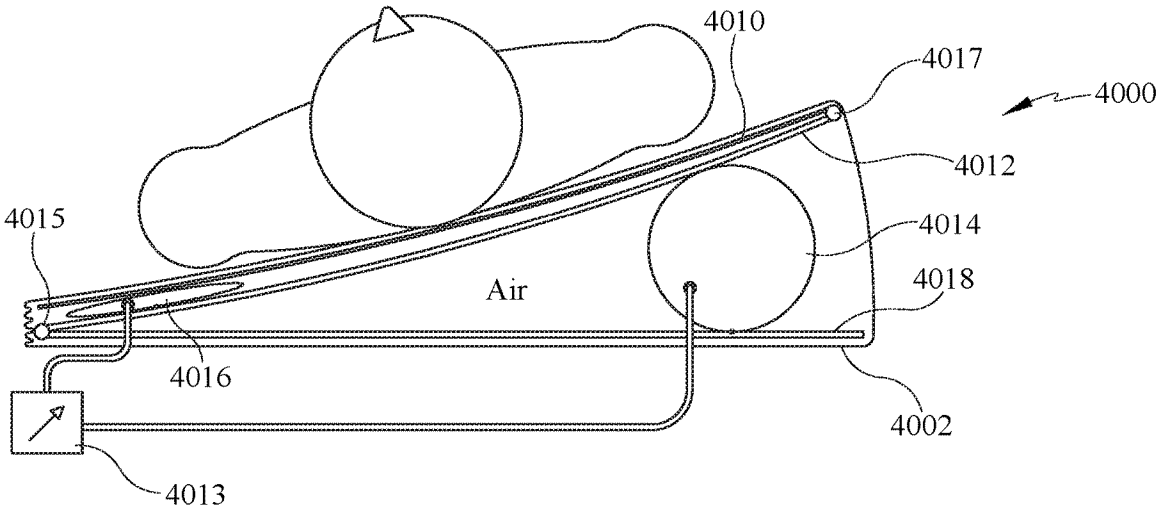
FIG. 8 is a schematic cross-sectional head end view of a mattress according to another embodiment of the present disclosure, having a Z-shaped bladder system, and showing the patient tilted toward their left side.
Figure 9:
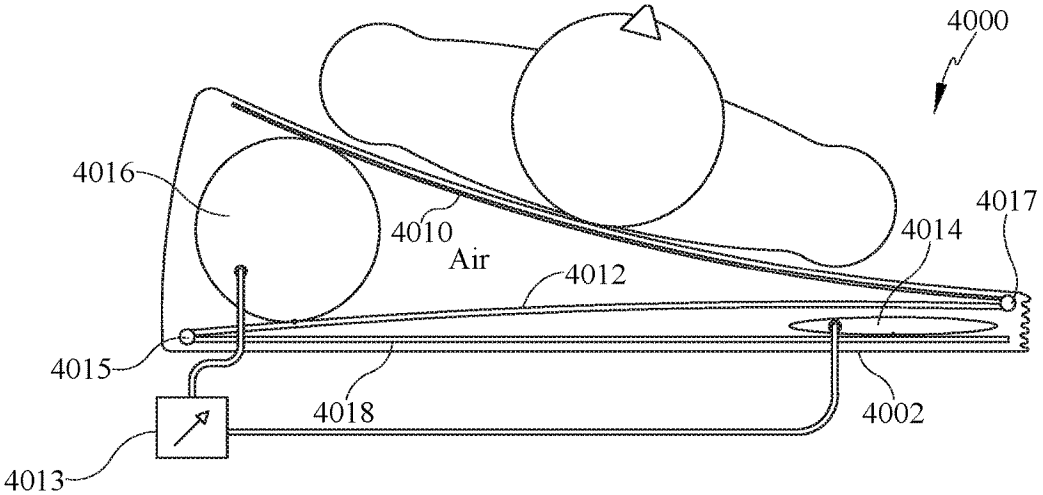
FIG. 9 is a schematic cross-sectional head end view of the mattress embodiment of FIG. 8, showing the patient tilted toward their right side.

FIG. 8 is a schematic cross-sectional head end view of a mattress 4000 according to another embodiment of the present disclosure, showing the patient tilted toward the left. FIG. 9 is a schematic cross-sectional head end view of the mattress 4000 of FIG. 8, showing the patient tilted toward the right. In this embodiment, the mattress 4000 includes a pair of bladders 4014 and 4016 spaced laterally from each other. The left side bladder 4016 is positioned below an upper plate 4010 and above an intermediate plate 4012. The right side bladder 4014 is positioned below the intermediate plate 4012 but above a lower plate 4018. The plates 4010 and 4012 are connected on the right side by a hinge 4017 so as to pivot relative to one another on one side of the mattress, while the plates 4012 and 4018 are connected on the left side via hinge 4015, so as to pivot relative to one another on the right side of the mattress. These plates 4010, 4012, and 4018 form a generally Z shaped configuration (with a bladder in between each adjacent pair of plates.)

Each bladder 4016 and 4014 can be separately inflated via air control system 4013, which includes a valving system. The valving system can be opened at to allow for air to flow from the air source into the bladder 4016, but not to bladder 4014, or can be opened to allow for air to flow into the bladder 4014, but not bladder 4016. Accordingly, the left and right sides of the mattress 4000 can be selectively inflated, to cause the mattress to turn left or right, to one lateral side or the other, causing the patient to turn one way or the other.

In this embodiment, the plates 4010, 4012, and 4018 are flexible in nature, so as to provide some give under the weight of the patient from the top. Accordingly, as shown in FIGS. 8 and 9, the top surface 4000 of the mattress forms a cradle surface during the turn operations, so as to help maintain the patient at the desired location on the mattress.

The mattress components of this embodiment are enclosed in a ticking material 4002, which can comprise a fabric material. Foam may also be included as desired, to allow for increased comfort and/or support at desired locations. For example, the bladders 4016 and 4014 can be as long as approximately one third of the mattress (along the head end and part of the torso end), while the remainder of the mattress (remainder of torso section and leg section) can transition to horizontal, such as via an angle foam piece. As another example, the lower ~⅔rd of the mattress 4000 can be shaped like the lower ⅔rd of the mattress shown in FIG. 1, and made from foam, as that embodiment is. Thus, in the embodiment of FIGS. 8 and 9, the mattress 4000 would transition from a large lateral angle near the head section to a small (or zero) lateral angle near the leg section.

In some embodiments the bladder 4014 or 4016 can be inflated to cause the head support surface to have a lateral angle of at least about 20 degrees, and the lateral angle is less in the torso support surface (e.g., at least about 10 degrees, but less than about 20 degrees), due to a smaller volume of the bladder near the torso section, or due to a transition to foam material having a smaller angle. To measure these angles, because the surface is non-linear, a straight linear path can be made from the uppermost point at the start of the inclined support surface to the lowermost point at the bottom of the inclined support surface, and that line compared to horizontal. (The same method can be utilized for measuring the other angles described herein.)

The plate 4010 of FIGS. 8 and 9 causing the cradle surface is larger than the patient width in this example, and can be from about 12 inches to about 36 inches, such as from about 15 to about 25 inches, for example, depending on what size patient the mattress is being designed or configured for. The curvature created by the flexing of the plate 4010 can be from about 5 to about 100 inches in radius, for example, such as about 7-50 inches, or about 10 to about 40 inches, or about 28.5 inches.

Figure 10:
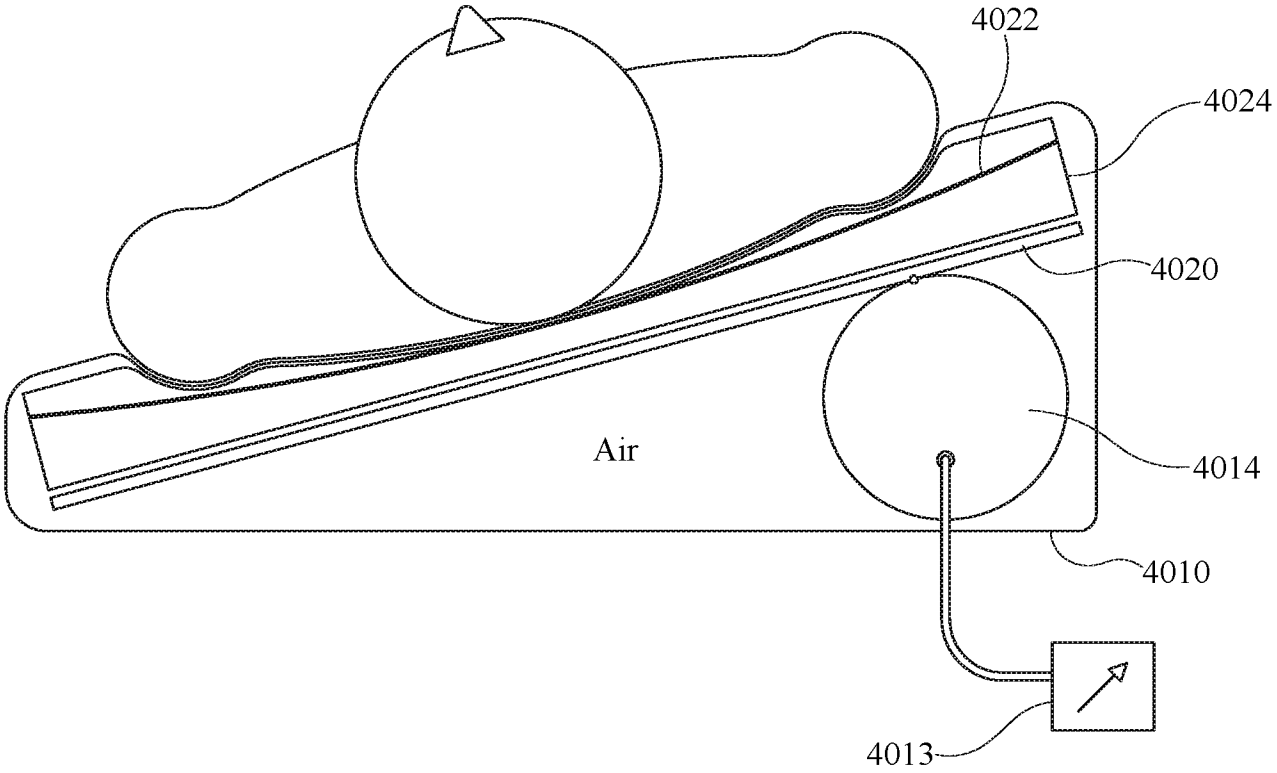
FIG. 10 is a schematic cross-sectional head end view of a mattress according to another embodiment of the present disclosure, having a single turn bladder system, and showing the patient tilted toward their left side.

FIG. 10 is a schematic cross-sectional head end view of a mattress according to another embodiment of the present disclosure, having a single turn bladder system, and showing the patient tilted toward their left side. Here, the system includes only a single bladder (bladder 4014) which is inflated by the air control system 4013 at desired times. If desired, a right turn bladder can be placed under the plate 4020 on the opposite side of the bladder 4014, in order to achieve turn in the other direction. As described above, the bladders can be placed only in the head and torso sections, but not in the leg section, so as to achieve a rotation in the head and torso area, but not the foot area (which may be supported by flat foam, non-tilted air bladders, or another support surface.)

In the embodiment of FIG. 10, a rigid plate 4020 is tilted upwardly and toward the left when the bladder 4014 is inflated. Above the plate 4020 is a topper system comprising a rigid, curved plate 4022 embedded in foam 4024. The curved plate 4022 has a radius of 28.5 inches in this example. In some embodiments, the radius of curvature of the plate is from about 5 inches to about 100 inches, such as from about 7 inches to about 50 inches for example, or about 10 to about 40 inches, for example. From the edge of the plate to its lowest point, a drop of 0.25 inches to 4 inches may be made, such as 1 inch for example.

In other embodiments, the curvature of the plate 4022 is noncontinuous. For example, the radius, or amount, of curvature could be greater on one lateral side of the plate than on the other. For instance, the curvature could be greater on the left (downhill) side of the plate 4022 shown in FIG. 10 than on the right (uphill side) of the plate, such that the plate forms a tilted generally J shape. This can provide a greater cradling effect on the downhill side than on the uphill side. Other shapes are possible as well, such as C shapes, and other continuous or non-continuous curved shapes.

As shown in FIG. 10, the mattress of this embodiment allows the patient to immerse into the top of the surface. In some embodiments, the amount of immersion in the mattress is between about 0.25 inches to about 4 inches (if air bladder 4014 is deflated and the mattress is horizontal), such as 1 inch for example, due to the foam 4024. The amount of immersion may be more on the left (downhill) side of the patient, than on the right (uphill side) of the patient, in this embodiment. Other ways of achieving cradling of the tilted patient via cradling are also possible. For example, in the embodiment of FIGS. 8 and 9, some immersion can be achieved through the air bladders 4014 and 4016 and the flexibility of the plates 4018, 4010, and 4012. Returning again to FIG. 10, the mattress is enclosed, and the components held together, by a cover, fabric, or ticking 4010.

Figure 11:
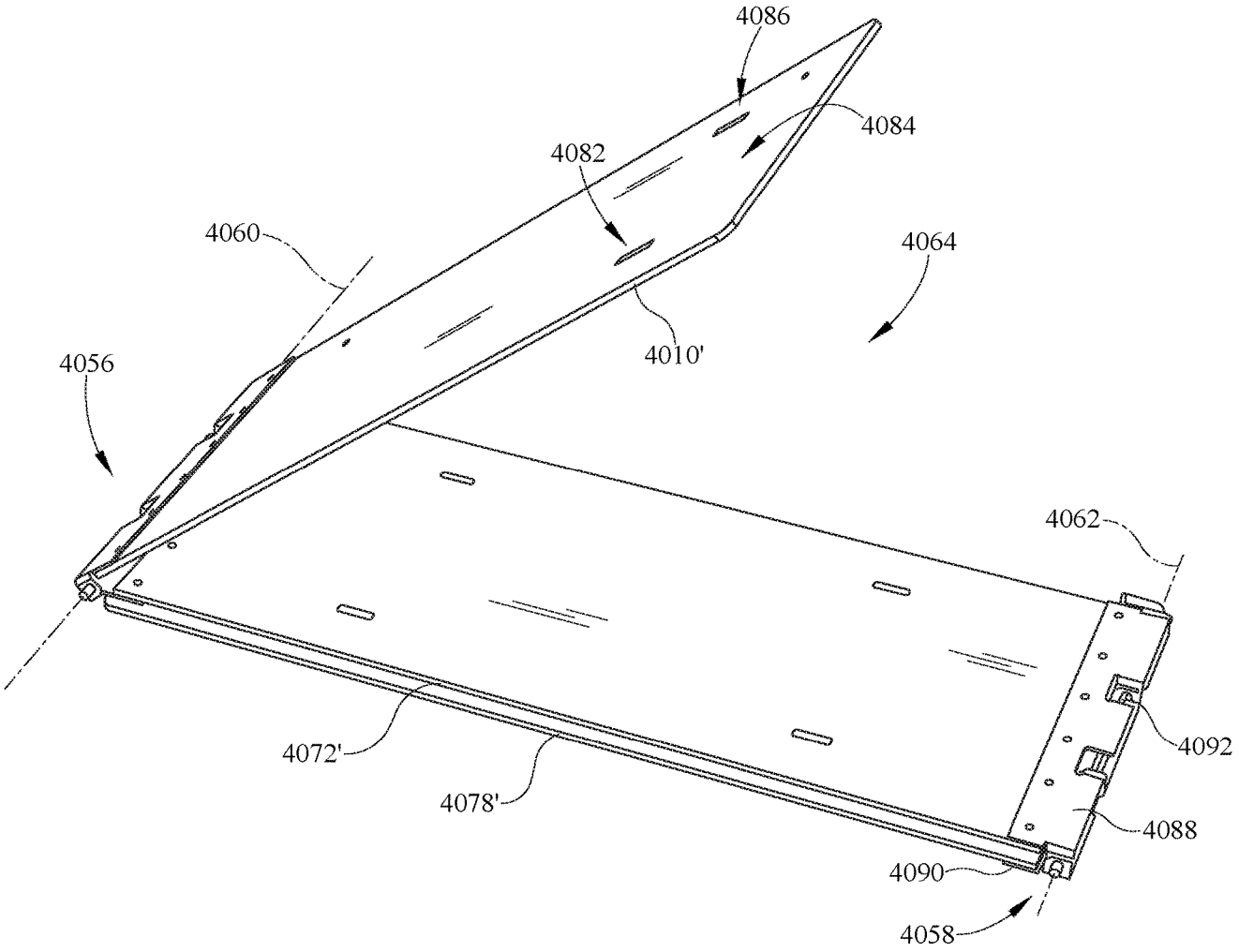
FIG. 11 is a perspective view of a Z shaped plate that may be used with some embodiments of the present disclosure.

FIG. 11 is a perspective view of a flexible Z shaped plate that may be used with some embodiments of the present disclosure. In this embodiment, the assembly causing the lateral turn includes a hinged support plate assembly 4064 which has two hinges 4056 and 4058 that define respective pivot axes 4060 and 4062. The hinges 4056 and 58 are positioned on opposite sides of the hinged support plate assembly 4064 so that the pivot axes 4060 and 4062 lie parallel to the longitudinal length of the mattress on opposite sides.

A pair of inflatable bladders can be positioned between the upper plate 4070 and intermediate plate 4072 of the hinged support plate assembly 4064 and a second pair of bladders 4074 and 4076 can be positioned between the intermediate plate 4072 and a lower plate 4078 as shown in FIG. 11. It should be understood that the plates 4070, 4072, and 4078 are flexible structures constructed of a resin composite, such as ABS plastic, but sufficiently stiff to hold the load between the interface between the bladders and the plates over the entire plate structure. For example, the plates 4070, 4072, and 4078 may have a flexural modulus in the range of 1 to about 10 GPa such as 2.5 GPa for example, and a strength of 10 to 70 MPa. In some embodiments, a polymer that is 1/16 to about 1 inch thick, such as 1/4 inch thick ABS for example, can provide suitable flexibility. Other thermoplastics could be utilized as well. The upper plate 4070 (and plate 4010 of FIG. 8) may flex between about 1 and about 10 inches (from its end to the side of the patient, to the middle directly under the patient), with support provided from the bladders and/or foam beneath the plate.

Each bladder can be secured to an adjacent plate 4070, 4072, or 4078 by a respective strap that is secured to the bladder and extends through an opening at one end of the respective plate 4070, 4072, or 4078 and lies on the side of the respective plate 4070, 4072, or 4078 opposite the bladder for a length and is then extends through another opening to reengage the bladder. The interaction of the strap 4080, the bladder, and the respective plate secures the bladder relative to the plate. The engagement of the strap with the plate can maintain the position of the bladder relative to the plate.

The hinges 4056 and 4058 include brackets secured to the plates that are engaged by a rod. For example, as shown in FIG. 11, hinge 4058 is formed by a bracket 4088 which is secured to intermediate plate 4072 and a bracket 4090 which is secured to lower plate 4078. The brackets 4088 and 4090 engage so that several in each bracket 4088 and 4090 align along the pivot axis 4062 so that a rod 4092 can be slid along the pivot axis 4062 to secure the bracket 4088 and 4090. The brackets 4088 and 4090 are movable relative to one another by pivoting on the rod 4092 relative to one another to change an angle between the intermediate plate 4072 and the lower plate 4078.

The various aspects of the above referenced embodiments can be applied to any of a variety of other embodiments. For example, any of the above aspects may be applied, in combination, or individually, to any of the embodiments shown or described in Appendix A of U.S. Provisional Patent Application No. 62/300,340 which is already incorporated by reference herein, and/or to any of the embodiments shown or described in US Patent Application Publication No. 2015/0335507, the entire disclosure of which is hereby incorporated herein by reference. For example, the cradling, concavity, and/or flexibility aspects and components described above may be applied, in combination, or individually, to any of the embodiments shown in FIGS. 1-146 of the Appendix A drawings, or described in the Appendix A text. As another example, the components described in U.S. patent application Ser. No. 62/168,596, the entire disclosure of which is hereby incorporated herein by reference, may be utilized to create the desired turn for the embodiments described herein.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and many combinations of aspects and principles are possible in light of the various embodiments provided above.

What is claimed is:

1. A sleep disorder treatment system, comprising:

a mattress may have a longitudinal length defined by a longitudinal axis of the mattress when the mattress is in its most horizontal position and a lateral width defined by a lateral axis of the mattress when the mattress is in its most horizontal position, wherein the mattress comprises:

a head section having a head support surface to support at least a portion of a person's head, wherein at least a portion of the head support surface is generally sloped in the lateral direction at an angle relative the lateral axis, wherein the angle of the head support surface is from about 10 degrees to about 30 degrees; and a torso section having a torso support surface to support at least a portion of a person's torso, wherein the torso support surface is generally sloped in the lateral direction at an angle relative to the lateral axis, and wherein the torso support section comprises a cradle surface extending downwardly and laterally from near one side of the torso support section to an opposite side of the torso support section, the cradle surface being provided by a rigid curved plate embedded in foam at an upper region of the torso support section.

2. The system as recited in claim 1, wherein the cradle surface is concave, wherein the cradle surface extends laterally a distance of from about 12 inches to about 36 inches, and wherein the cradle surface comprises at least one curved surface having a radius of curvature from about 5 inches to about 100 inches.

3. The system as recited in claim 1, wherein the angle of slope of the head support surface is at least about 20 degrees, and the angle of slope of the torso support surface is at least about 10 degrees.

4. The system as recited in claim 1, wherein the torso support section flexes during use.

5. The system as recited in claim 1, further comprising at least one turn bladder configured to adjust the slope of the torso support section.

6. The system as recited in claim 1, wherein the rigid curved plate is closer to an upper surface of the foam than to a lower surface of the foam.

7. The system as recited in claim 1 wherein the rigid curved plate is made of polycarbonate.

8. The system as recited in claim 1, wherein the rigid curved plate has a radius of from about 7 inches to about 50 inches.

9. The system as recited in claim 1 wherein the rigid curved plate is embedded in the foam such that a greater quantity of foam is situated beneath the rigid curved plate than is situated above the rigid curved plate.

10. The system as recited in claim 1, further comprising a bolster, wherein the bolster extends along at least a portion of the torso support surface.

11. A sleep system for supporting a person, the sleep system having a lateral width and longitudinal length and a top surface, the sleep system comprising a first turn bladder;

a first flexible plate provided on top of at least a portion of the first turn bladder;

a second turn bladder laterally spaced from the first turn bladder, wherein at least a portion of the first flexible plate is positioned underneath the second turn bladder;

a second flexible plate positioned on top of at least a portion of the second turn bladder;

a cradle surface provided on top of the second flexible plate, the cradle surface being provided by a rigid curved plate embedded in foam that covers the second flexible plate; and an air control system including an air source, wherein the air control system is configured to selectively deliver air to the first turn bladder and the second turn bladder to cause the sleep system to tilt laterally right or laterally left, wherein the flexible plates flex when under top load and the sleep system is laterally tilted.

12. The sleep system as recited in claim 11, wherein the at least one of the first and second flexible plates flex under a weight of a person when at least one of the first and second turn bladders are inflated.

13. The sleep system as recited in claim 11, wherein the sleep system comprises a head support surface having an angle of at least about 20 degrees, and a torso support surface having an angle of at least about 10 degrees.

14. The sleep system as recited in claim 11, wherein the sleep system comprises a head support surface having a first lateral angle, a torso support surface having a second lateral angle, and a leg support surface having a third lateral angle, wherein the first lateral angle is greater than the second lateral angle, and wherein the second lateral angle is greater than the third lateral angle.

15. A sleep system, comprising a head support section;

a torso support section;

a leg support section, wherein the head support section is generally laterally angled at an angle greater than the lateral angle of the torso support section and the leg support section;

a cradle surface provided on at least an upper portion of the torso support section, the cradle surface being provided by a rigid curved plate embedded in foam that covers the torso support section.

16. The system as recited in claim 15, wherein the cradle surface is generally concave and has a lateral width of from about 12 inches to about 36 inches.

17. The system as recited in claim 15, wherein the rigid curved plate is embedded in the foam such that a greater quantity of foam is situated beneath the rigid curved plate than is situated above the rigid curved plate.

18. The system as recited in claim 17, wherein the rigid curved plate comprises a polycarbonate material and has a radius of curvature of from about 5 to about 100 inches.

19. The system as recited in claim 15, wherein the cradle surface comprises a thermoplastic having a thickness of between about ⅛ inch to about ½ inch.

20. The system as recited in claim 15, wherein the torso support section comprises at least two flexible plates and at least two turn bladders, each bladder being provided underneath at least one plate.

* * * * *